United States Patent [19]

Davis

[11] 3,994,210

[45] Nov. 30, 1976

[54] JET FUME CONTROL SYSTEMS

[75] Inventor: John A. Davis, Tottenham, Canada

[73] Assignee: Powlesland Engineering Limited, Rexdale, Canada

[22] Filed: Nov. 24, 1975

[21] Appl. No.: 634,417

[52] U.S. Cl. ..... 98/115 R; 98/36; 110/160; 432/72; 202/263; 266/144

[51] Int. Cl.[2] ..... F23J 11/12

[58] Field of Search ..... 98/36, 115 R, 115 LH; 110/160; 432/72; 13/9 R; 202/254, 263; 266/158, 159, 144

[56] References Cited

UNITED STATES PATENTS

| | | | |
|---|---|---|---|
| 2,451,418 | 10/1948 | Tree | 98/36 X |
| 3,396,651 | 8/1968 | Kamiya et al. | 98/36 X |
| 3,575,398 | 4/1971 | Lincoln et al. | 98/36 X |
| 3,760,446 | 9/1973 | Payton | 98/36 X |
| 3,834,293 | 9/1974 | Danieli | 98/36 |

*Primary Examiner*—William E. Wayner
*Assistant Examiner*—Ronald C. Capossela
*Attorney, Agent, or Firm*—Sim & McBurney

[57] ABSTRACT

This invention provides a method and apparatus for exhausting rising fume from a fume-producing apparatus into a hood opening located above but laterally displaced from the fume-producing apparatus. A first jet producing a moving curtain of air is directed generally across the fume-producing apparatus from the side thereof which is remote from the hood, with the curtain at least wide enough to span substantially the whole of the rising fume. A second jet produces a second moving curtain of air travelling generally upwardly toward the hood opening from a position spaced generally beneath that opening. The energy and direction of the first jet and the resultant air curtain are such that, if the second jet were not present, the resultant paths for all portions of the air/fume mixture would traverse the general region between the hood opening and the position of which the second jet originates.

8 Claims, 5 Drawing Figures

JET FUME CONTROL SYSTEMS

This invention relates generally to fume control systems for use in industrial applications where undesirable fumes are generated in quantities which require removal, and has to do particularly with a method and apparatus by which jets in the form of moving curtains of air are utilized to control and direct the movement of fume from a fume-generating apparatus, thereby to facilitate the disposal of the fume.

DESCRIPTION OF CONVENTIONAL PRACTICE

In this section, the conventional practice relating to metallurgical installations will be described in terms of the fume-control problems which must be dealt with, although it will be appreciated from what follows that the method and apparatus of this invention is applicable to a large number of areas outside the metallurgical field.

In the metallurgical industry, it is common to encounter, at different stages of the processes involved, sources of strongly rising contaminated fume. An example would be ladles containing molten metal. In many such instances, no hood or similar form of fume control can be utilized because of the interference with cranes and other equipment, and because of the necessity for creating a clear access to the different portions of the installation.

It was with the foregoing difficulty in mind that the present invention was developed.

GENERAL DESCRIPTION OF THIS INVENTION

Accordingly, this invention provides a method of exhausting rising fume from a fume-producing apparatus into a hood opening located above but laterally displaced from the fume-producing apparatus, said method comprising the steps: directing a horizontally elongated first jet of air generally across the fume-producing apparatus from the side thereof which is remote from said hood, said frist jet of air being at least wide enough to span substantially the whole of the rising fume, directing a horizontally elongated second jet of air generally upwardly toward the hood opening from a position spaced generally beneath the hood opening, the energy and direction of said first jet of air being such that, in the absence of the second jet, the resultant paths for all portions of the fume would traverse the region between said position and the hood opening.

This invention further provides, in combination: a fume-producing apparatus creating a fume having a natural tendency to rise vertically from said apparatus, an exhaust hood having a hood opening located above but laterally displaced from the fume-producing apparatus, a horizontally elongated first jet means on the side of the apparatus remote from the hood opening for blowing a first jet-like curtain of air generally across the apparatus, the curtain of air being at least wide enough to span substantially the whole of the rising fume, and a horizontally elongated second jet means at a location spaced generally beneath the hood opening, for blowing a second jet-like curtain of air generally upwardly toward the hood opening, said first jet means being capable of creating a curtain of air having a direction and an energy content such that, in the absence of the second curtain of air, the resultant paths for all portions of the fume would traverse the region between the second jet means and the hood opening.

GENERAL DESCRIPTION OF THE DRAWINGS

One embodiment of this invention is illustrated in the accompanying drawings, in which like numerals denote like parts throughout the several views, and in which.

DETAILED DESCRIPTION OF THE DRAWINGS

Figure 1:
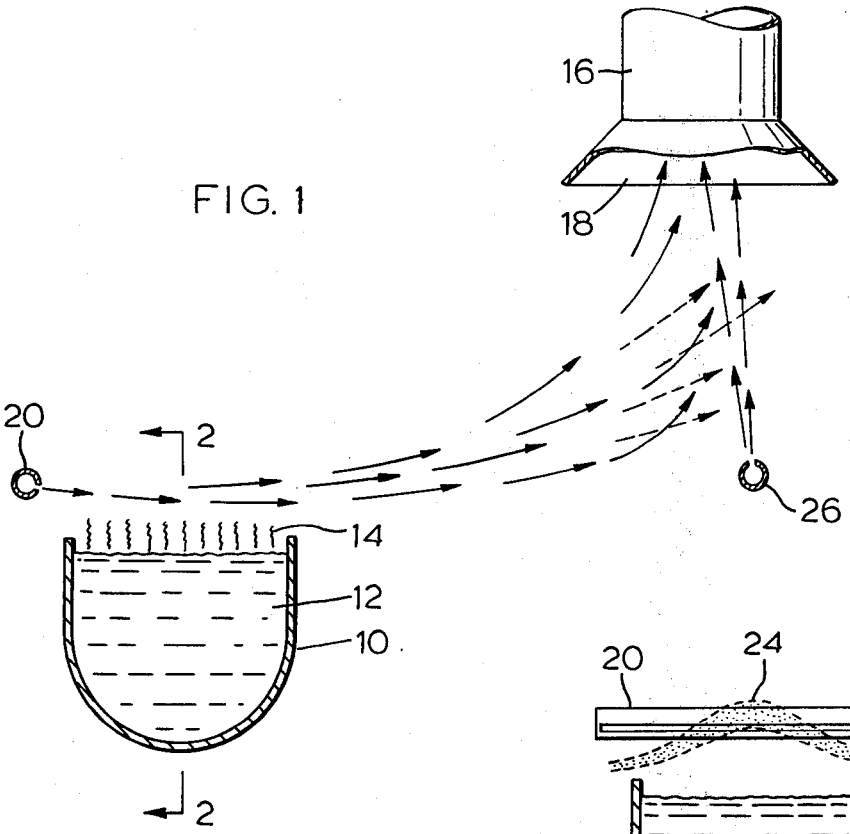
FIG. 1 is a schematic elevational view of apparatus constructed in accordance with this invention.

In FIG. 1, a ladle 10 is shown containing molten metal 12, the latter giving rise to buoyant fume 14 usually containing particulates and certain gases generally considered to be contaminants. Since personnel usually work in close proximity to ladles such as that illustrated, it is essential for reasons of health to avoid any build-up of the contaminated fume in the working area. Typically, an exhaust hood is provided directly over the source of the contaminated fume, but in the case of the apparatus in FIG. 1 it is assumed to be not feasible to place a hood directly over the ladle 10. Instead, a hood 16 with a hood opening 18 is located above but laterally displaced from the fume producing ladle 10. In order to move the fume 14 laterally to a location where it can be collected through the hood opening 18, a horizontally elongated jet means 20 is provided on the side of the ladle 10 which is remote from the hood opening 18 (i.e. on the left-hand side as pictured in FIG. 1, the hood opening being to the right of the ladle 10). The jet means 20 may take any suitable form, one appropriate form being that of a horizontally elongated cross-flow blower. It is to be understood that the jet means 20 in FIG. 1 is elongated in the direction perpendicular to the plane of the drawing paper. Moreover, for reasons which will appear subsequently, it is important that the jet or curtain of air expelled by the jet means 20 be at least wide enough (i.e. in the direction perpendicular to the drawing paper) to span substantially the whole of the fume rising from the ladle 10, which in practice would require an expelled curtain or jet of air at least as wide as the opening at the top of the ladle 10 itself.

Figure 2:
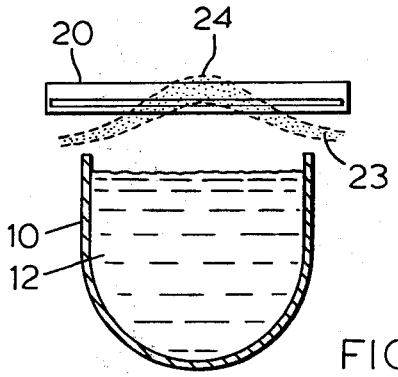
FIG. 2 is a vertical sectional view taken at the line 2—2 in FIG. 1.

It will be clearly understood that, for each fume-producing apparatus, and for each specific direction and energy of expelled air from the jet means 20, the resultant path of the combination of air and fume will vary. To be more specific, in a ladle such as that illustrated, assumed to be circular in horizontal section, the fume 14 will end to rise most strongly in the middle of the ladle, and less strongly toward the edges. This is because the greatest span of hot, molten metal lies across a diameter, with smaller spans as one moves away from the diameter. This would mean that, if the jet means 20 were to throw a curtain of air across the ladle which was of uniform energy as measured longitudinally of the jet means 20, the curtain of air all being delivered at the same angle with respect to the horizontal, the resultant path and the mixture of air and fume passing over the diametral portion of the ladle 10 would follow a faster rising path than that passing over the edges of the ladle. This is illustrated in FIG. 2, where the stippled area above the ladle 10, marked with the numeral 23, represents the resultant mixture of air and fume by the time it reaches the middle of the ladle 10. It can be seen that the curtain, now mixed with fume, has a central "hump" 24 as a result of the greater tendency of the fumes in the center of the ladle to rise. If only the single jet means 20 were provided, the result of the variable rising energy of the fume would be that different portions of the air/fume mixture would follow different paths. In this context, it is conceivable that the energy of the air curtain expelled by the jet means 20 could be directed and controlled in such a way that, say, the central portion of the air/fume mixture represented by the hump 24 would exactly pass into and through the hood opening 18, while the outer "edge" portions of the mixture would pass beneath and beyond the hood opening 18 and not be exhausted. In order to allow for this differential rising tendency of the air/-fume mixture with a single jet means 20, the jet means itself would have to be capable of delivering an air curtain with differential energy content (quantity of air and/or speed) along its length. Moreover, since no two ladles are the same, and since the rising energy of fume produced by any given fume-producing apparatus can vary widely from installation to installation, it would also be necessary to provide a jet means 20 with a varying total energy output, as well as the capability of establishing differential energy levels longitudinally of the jet means.

In order to remove these difficulties, a second jet means 26 is provided at a location spaced generally beneath the hood opening 18, and adapted to blow a second jet-like curtain of air generally upwardly toward and into the hood opening 18. Like the first jet means 20, the second jet means 26 is horizontally elongated in the direction perpendicular to the drawing paper, and may, as a non-limiting example, consist of a second cross-flow blower. The jet means 26 is capable of delivering a curtain of air expelled generally upwardly toward the hood opening 18, and is situated in such a way as to be generally beneath the lowest or "flattest" path of air/fume mixture from the first jet means 20 passing over the ladle 10. Expressed in a different way, the first jet means 20 is capable of creating a curtain of air having a direction and an energy content such that the resultant paths for all portions of the air/fume mixture would normally (in the absence of the second jet means 26) traverse the region between the second jet means 26 and the hood opening 18. In FIG. 1, the broken-line arrows in the region beneath the hood 16 represent the normal follow-through path of the air/-fume mixture as caused by the first jet means 20. The lower-most broken-line arrows represent the path of the portions of the mixture resulting from the edges of the ladle 10 (the end portions of the region 23 in FIG. 2), and the uppermost broken-line arrows represent the path of the central hump portion 24 of the region 23 in FIG. 2.

The presence of the second jet means 26, however, situated beneath the hood opening 18 and under the lowermost path of air/fuel mixture, results in the upward entrainment of all of the air/fuel mixture such that all of the mixture is carried directly into the hood opening 18. This is illustrated by the upward bending of the path of the mixture as seen by the solid-line arrows in FIG. 1.

Thus, it will be seen that it is not necessary to provide a first jet means 20 (or a second jet means 26, for that matter) with varying or differential energy capability along its length. The fact that a humped air/fuel mixture region is created as illustrated in FIG. 2 does not cause any difficulty, since all portions of the air/fuel mixture, regardless of where these portions would normally cross a hypothetical line drawn between the second jet means 26 and the hood opening 18, are entrained in the second curtain of air proceeding upwardly from the second jet means 26.

In a preferred embodiment of this invention, the curtain of air expelled by the first jet means 20 is angled downwardly at a slight angle to the horizontal, for reasons now to be described. It will be seen from what follows that if the curtain of air issuing from the first jet means 20 is angled downwardly, less initial energy need be put into that curtain of air, which means in effect a smaller volume of air expelled from the first jet means 20, which in turn results in a smaller capture volume in the hood opening 18.

Figure 3A:
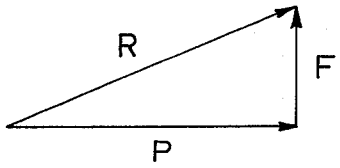
FIGS. 3A, 3B and 3C are diagrams intended to illustrate the theoretical basis for a preferred embodiment of this invention.
Figure 3B:
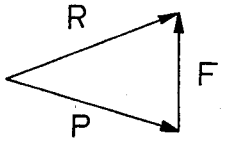
Figure 3C:
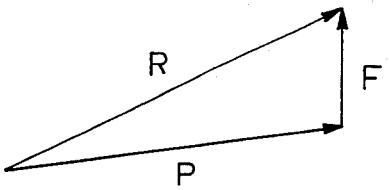

Attention is directed to FIGS. 3A, 3B, and 3C for an explanation of the way in which a downwardly curtain of air from the first jet means results in a smaller amount of required energy in that curtain of air.

Attention is first directed to FIG. 3A, which shows two vectors P and F giving rise to a resultant vector R. Vector P presents a horizontal first or "primary" jet of air from the first jet means 20, and vector F represents the energy or buoyant force in the fume. If the vector F is of a given value, and we want to have a resultant vector R at a specified angle (in order to carry the air/fuel mixture to the hood opening 18), we must supply energy represented by the vector P in the initial or primary curtain of air from the first jet means 20. Going to FIG. 3C, it is seen that for the same fume energy vector F, the required resultant directional angle is obtained by a considerably increased primary jet curtain energy (vector P) when that curtain has a slight upward inclination as measured to the horizontal. However, referring to FIG. 3B, when the initial or primary curtain of air from the first jet means 20 is angled downwardly with respect to the horizontal, again given the same upward buoyancy or energy in the fume vector F, a resultant vector of the required angle is obtained with considerably less energy in the primary curtain (shorter arm P of the triangle).

In a preferred form of this invention, a primary curtain of air from the first jet means 20 is angled downwardly with respect to the horizontal, thus requiring less initial energy in the primary curtain, and resulting in less capture volume passing into and through the hood opening 18.

It will be understood that, in the absence of the second jet means 26, it would not be possible to provide a downwardly sloping primary curtain of air from the first jet means 20 while at the same time accommodating a large variety of fume energies and fume energy distributions. Instead, it would be necessary to angle the primary jet from the first jet means 20 upwardly along a line aimed at a point almost directly beneath the hood opening 18, to ensure that all entrained fume would pass through or very close to the hood opening 18. However, a significant increase in the energy (volume and speed) of the initial or primary curtain of air from the first jet means 20 would be required to overcome the problems associated with differential rising or buoyant energy of the fume across the ladle. As a result, the greater volume of air per unit time expelled from the first jet means 20 would require a larger hood and greater energy consumption by the first jet means 20, and also would mean more contaminated air (in terms of gas volume) to be disposed of. This invention, by providing the second jet means 26, allows the primary curtain of air from the first jet means 20 to be angled downwardly, and this in turn permits a smaller energy content in the primary curtain of air from the first jet means 20, which in turn reduces energy consumption in the first jet means 20 and the capture volume for the hood opening 18.

I claim:

1. A method of exhausting rising fume from a fume-producing apparatus into a hood opening located above but laterally displaced from the fume-producing apparatus, said method comprising the steps:

directing a horizontally elongated first jet of air generally across the fume-producing apparatus from the side thereof which is remote from said hood, said first jet of air being at least wide enough to span substantially the whole of the rising fume, directing a horizontally elongated second jet of air generally upwardly toward the hood opening from a position spaced generally beneath the hood opening, the energy and direction of said first jet of air being such that, in the absence of the second jet, the resultant paths for all portions of the fume would traverse the region between said position and the hood opening.

2. The method claimed in claim 1, in which the first jet of air is directed across and obliquely downwardly from its point of origin.

3. The method claimed in claim 1, in which the fume from the fume producing apparatus has greater energy content and tendency to rise in some portions than it does in others, and in which the energy and direction of said first jet of air are such that the resultant path of the most strongly rising portion of the fume carries that portion to the hood opening, and such that the resultant path of the least strongly rising portion of the fume carries said least-mentioned portion to a location closer to the origin of said second jet of air.

4. The method claimed in claim 3, in which the first jet of air is directed across and obliquely downwardly from its point of origin, such that its initial path has a component countering the rising tendency of the fume.

5. The method claimed in claim 4, in which the strength of each jet of air is substantially uniform along its direction of elongation.

6. In combination:

a fume-producing apparatus creating a fume having a natural tendency to rise vertically from said apparatus, an exhaust hood having a hood opening located above but laterally displaced from the fume-producing apparatus, a horizontally elongated first jet means on the side of the apparatus remote from the hood opening for blowing a first jet-like curtain of air generally across the apparatus, the curtain of air being at least wide enough to span substantially the whole of the rising fume, and a horizontally elongated second jet means at a location spaced generally beneath the hood opening, for blowing a second jet-like curtain of air generally upwardly toward the hood opening, said first jet means being capable of creating a curtain of air having a direction and an energy content such that, in the absence of the second curtain of air, the resultant paths for all portions of the fume would traverse the region between the second jet means and the hood opening.

7. The invention claimed in claim 6, in which the first jet means is a cross-flow blower adapted to project its air curtain across and obliquely downwardly from its point of origin.

8. The invention claimed in claim 7, in which the said cross-flow blower projects air with uniform energy content along its length, and in which the second jet means is another cross-flow blower.

* * * * *